United States Patent [19]

Hailey

[11] Patent Number: 4,809,793

[45] Date of Patent: Mar. 7, 1989

[54] ENHANCED DIAMETER CLEAN-OUT TOOL AND METHOD

[76] Inventor: Charles D. Hailey, 11628 Burning Oaks Rd., Oklahoma City, Okla. 73150

[21] Appl. No.: 110,219

[22] Filed: Oct. 19, 1987

[51] Int. Cl.[4] ..... E21B 10/32

[52] U.S. Cl. ..... 175/265; 175/266; 175/267; 166/297; 166/312

[58] Field of Search ..... 175/265, 266, 267; 166/297, 311, 312

[56] References Cited

U.S. PATENT DOCUMENTS

| | | | |
|---|---|---|---|
| 392,592 | 11/1888 | Douglass . | |
| 1,494,274 | 5/1924 | Morgan . | |
| 2,180,452 | 11/1939 | Boulter | 255/76 |
| 2,284,170 | 5/1942 | Santiago | 255/76 |
| 2,548,931 | 4/1951 | Baker | 255/76 |
| 2,660,240 | 11/1953 | Ringler | 164/0.7 |
| 2,814,463 | 11/1957 | Kammerer, Jr. | 175/267 |
| 2,822,150 | 2/1958 | Muse et al. | 175/266 |
| 3,050,122 | 8/1962 | Huitt et al. | 166/55.8 |
| 3,050,143 | 8/1962 | Kammerer et al. | 175/267 X |
| 3,316,970 | 5/1967 | Huitt et al. | 166/55.7 |
| 4,064,951 | 12/1977 | Weber | 175/45 |
| 4,431,065 | 2/1984 | Andrews | 175/269 |

FOREIGN PATENT DOCUMENTS

| | | |
|---|---|---|
| 330433 | 6/1930 | United Kingdom . |
| 497877 | 12/1938 | United Kingdom . |
| 1218915 | 1/1971 | United Kingdom . |

OTHER PUBLICATIONS

Bulletin Describing Bowen Internal Pressure Pipe Cutter (Believed to be pre-Oct. 19, 1986)-one page.

Kat Tool Inc. Brochure on Thru Tubing Tools (Clean--out, Cable Cutters, Tubing Cutters) (Believed to be pre-Oct. 19, 1986)-four pages.

SlimDrill, Inc. brochure (pre-Oct. 19, 1986)-reprinted from 36th (1984-85) Composite Catalog, pp. 6719-6722.

*Primary Examiner*—William P. Neuder

*Attorney, Agent, or Firm*—Laney, Dougherty, Hessin & Beavers

[57] ABSTRACT

A downhole cutting tool, specifically adapted to function as an enhanced diameter clean-out tool, includes longitudinal bores which are opened to fluid flow when cutting members are moved to their extended positions. Upper and lower subassemblies are connected through an adapter which establishes an angular offset between an upper pair of extendible members and a lower pair of extendible members, which upper pair functions as a stabilizing structure to stabilize rotation of the tool and which lower pair functions as an enhanced diameter cutter.

24 Claims, 4 Drawing Sheets

ENHANCED DIAMETER CLEAN-OUT TOOL AND METHOD

BACKGROUND OF THE INVENTION

This invention relates generally to downhole cutting tools and cleaning methods and more particularly, but not by way of limitation, to clean-out tools having enhanced stability and including longitudinal fluid channels defined therethrough and used a method for removing material from a tubular string and/or a borehole.

Casing fixed downhole in a well bore sometimes needs to be cleaned of cement, sand, shale, mud and other types of deposits as is known in the oil and gas industry. This requires a type of tool which can be lowered through a relatively narrow diameter tubing string to clean the tubing string and which can be lowered for subsequent use to clean below the lower end of the tubing string in the relatively wider diameter casing. This type of tool will be referred to herein as an enhanced diameter clean-out tool, or simply a clean-out tool. An early form of such a clean-out tool which has been in commercial use is disclosed in my U.S. patent application Ser. No. 888,418, filed July 23, 1986, now abandoned.

Other types of tools have been disclosed to include blades which are to be retracted within the support portion of the tool so that the blades and the tool can pass through tubing string having an inner diameter smaller than the maximum diameter of the blades when they are extended. Once having passed through the tubing string, the blades can be extended outwardly to cut out a diameter up to substantially the inner diameter of the casing or other borehole surface within which the tool is used.

It is my understanding that some tools which have been proposed or used have utilized springs to extend or retract the blades or have otherwise been mechanically operated to achieve the movement of the blades between their extended and retracted positions. Pistons moved by pressurized fluid have also been used to extend the blades. Some of these tools also have had jet ports through which fluid can be ejected to assist in cutting the material and in subsequently flushing the cut material out of the well. Others use ports which are opened to pressure-affecting fluid flow in response to the blades being extended.

Larger diameter tools of a generally similar type have been used in the cutting and parting of casing strings but these have not been of a type that can be passed through smaller diameter tubulars.

I am also aware of a pipe or casing cutter which cuts pipe or casing at its outer point and not along its side edges. A specific type of cutter of which I am aware is a Bowen internal pressure pipe cutter having a plurality of knives each separately pivotally connected within a body in which a piston is also disposed. The piston is used to drive the blades outwardly to apply pressure by which a pipe is cut.

A formation notching apparatus including two sets of cutting elements is disclosed in U.S. Pat. No. 3,050,122.

Although there are various types of downhole cutting devices, there has existed the need for an improved clean-out tool which has enhanced stability so that it can be used effectively, without substantial vibrations being created, on what is known as a coil tubing motor. An example of one such motor is known as a SLIMDRIL motor marketed by SlimDril, Inc. of Houston, Tex. There has also existed the need for an improved clean-out tool which provides significant liquid flow longitudinally through it for washing out, or otherwise lubricating, cuttings but which also generates through such liquid flow signals indicating when the extendible elements of the tool have opened.

SUMMARY OF THE INVENTION

The present invention meets the aforementioned needs by providing a downhole enhanced diameter clean-out tool which includes channels through which cutting-lubricating liquid flows to provide signals indicating when extendible elements of the tool have opened. In one embodiment the tool has two sets of extendible elements angularly offset relative to each other to provide enhanced stability when the tool is rotated.

One embodiment of the downhole enhanced diameter clean-out tool of the present invention comprises: a body including a slot defined laterally therethrough and further including a longitudinal cavity defined therein in communication with the slot; two cutting members pivotally mounted in the slot; movement means, disposed in the cavity so that the movement means is movable between a first position in the cavity and a second position in the cavity, for moving the cutting members to respective extended positions in response to a force acting on the movement means to move the movement means from the first position to the second position; and the body further including: first channel means, defined in the body and spaced from the slot, for communicating a liquid from the cavity to an outlet of the first channel means regardless of the position of the movement means between the first and second positions; and second channel means, defined in the body and spaced from the slot and the first channel means, for communicating a liquid from the cavity to an outlet of the second channel means in response to the movement means moving from the first position to the second position.

Another embodiment of the downhole enhanced diameter clean-out tool of the present invention comprises: an elongated support; a first pair of extendible members pivotally connected to the support to move between retracted and extended positions within a first longitudinal plane; first movement means, disposed in the support, for moving the first pair of extendible members to respective extended positions; a second pair of extendible members pivotally connected to the support to move between retracted and extended positions within a second longitudinal plane, the second plane offset at an angle from the first plane so that the first and second pairs of extendible members effect enhanced rotational stabilization when the support is rotated; and second movement means, disposed in the support, for moving the second pair of extendible members to respective extended positions.

The present invention also encompasses a method of cutting material, such as cement, located within a borehole, such as a cased well bore, having tubing located in the borehole. This method comprises the steps of: lowering a clean-out tool into the tubing, which clean-out tool includes a first pair of members movable below the tubing to an extended position in response to a pressurized fluid, and a second pair of members movable below the tubing to an extended position in response to a pressurized fluid; rotating and lowering the clean-out tool through the lower end of the tubing and into the borehole; applying a pressurized fluid to the clean-out tool so that the first pair of members is moved to its extended position when the first pair of members is lowered below the tubing and into the borehole; transmitting, to the surface from which the borehole and tubing extend, a signal indicating the first pair of members has moved to its extended position within the borehole below the tubing; maintaining rotating and lowering the clean-out tool in the borehole through and after the step of transmitting and cutting the material with the extended first pair of members; maintaining applying a pressurized fluid to the clean-out tool so that the second pair of members is moved to its extended position when the second pair of members is lowered below the tubing and into the borehole; transmitting to the surface a signal indicating the second pair of members has moved to its extended position within the borehole below the tubing; and maintaining the first and second pairs of members in their respective extended positions simultaneously, and concurrently continuing rotating and lowering the clean-out tool against the material in the borehole and stabilizing the rotating clean-out tool with the extended second pair of members and cutting the material in the borehole with the extended first pair of members.

Therefore, from the foregoing, it is a general object of the present invention to provide a novel and improved downhole enhanced diameter clean-out tool and method. Other and further objects, features and advantages of the present invention will be readily apparent to those skilled in the art when the following description of the preferred embodiments is read in conjunction with the accompanying drawings.

DETAILED DESCRIPTION OF THE PREFERRED EMBODIMENTS

Figure 1A:
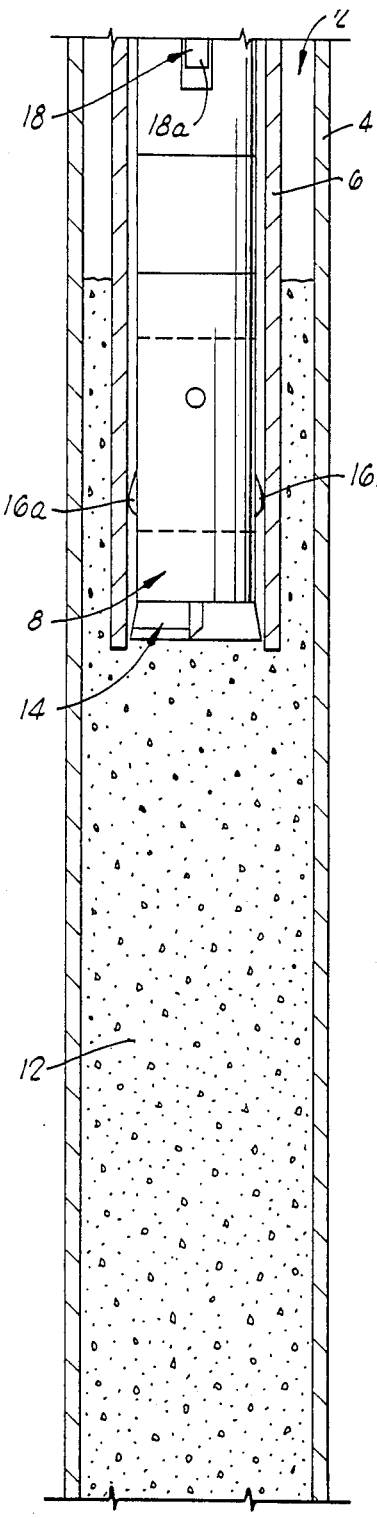
FIG. 1A is a schematic illustration of a preferred embodiment of the clean-out tool of the present invention located within a tubing string disposed within a cased well bore, which tool is shown as having fluid pressure applied thereto so that extendible members are partially extended to clean the inside of the tubing string.
Figure 1B:
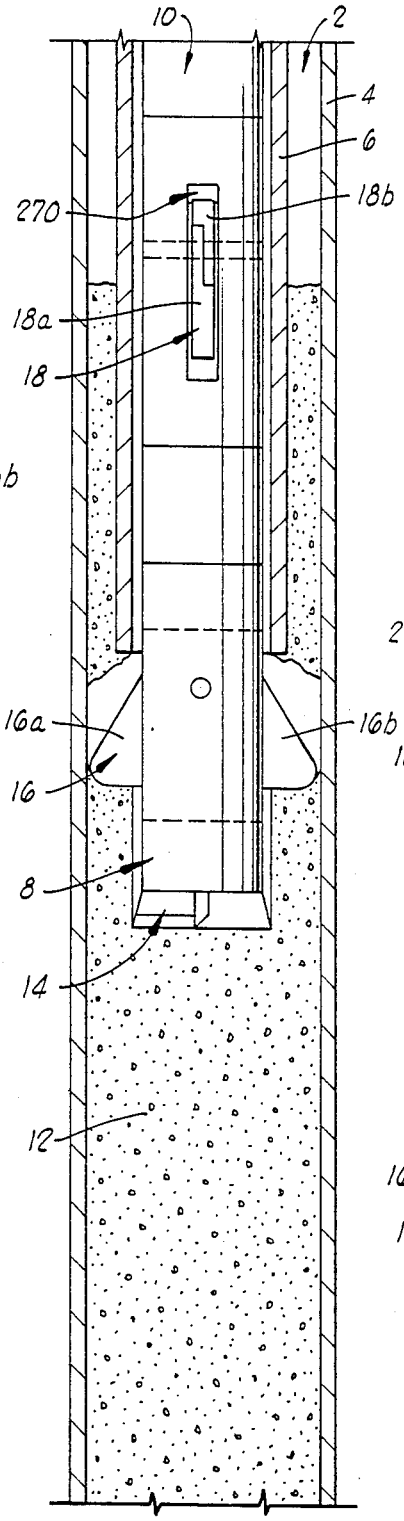
FIG. 1B is a schematic illustration showing the preferred embodiment of the tool from FIG. 1A in a lower position so that a set of extendible members (specifically, cutting members) of the tool are opened below the tubing string.
Figure 1C:
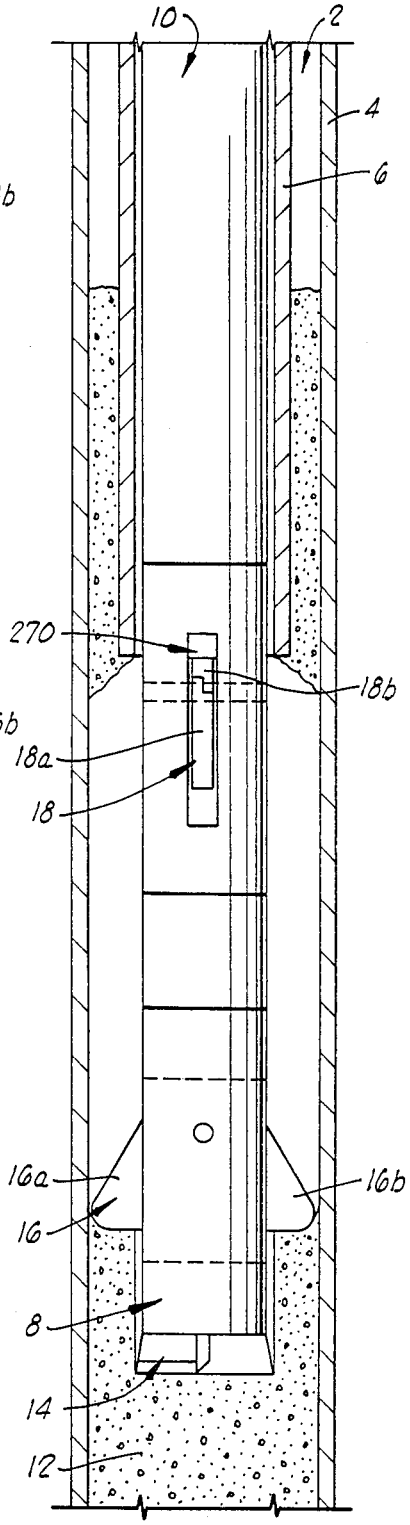
FIG. 1C is a schematic illustration showing the preferred embodiment of the tool from FIG. 1A in a still lower position so that both the set of cutting members and an upper set of the extendible members, used primarily for stabilization but also possibly providing some cutting, are opened below the tubing string.
Figure 2:
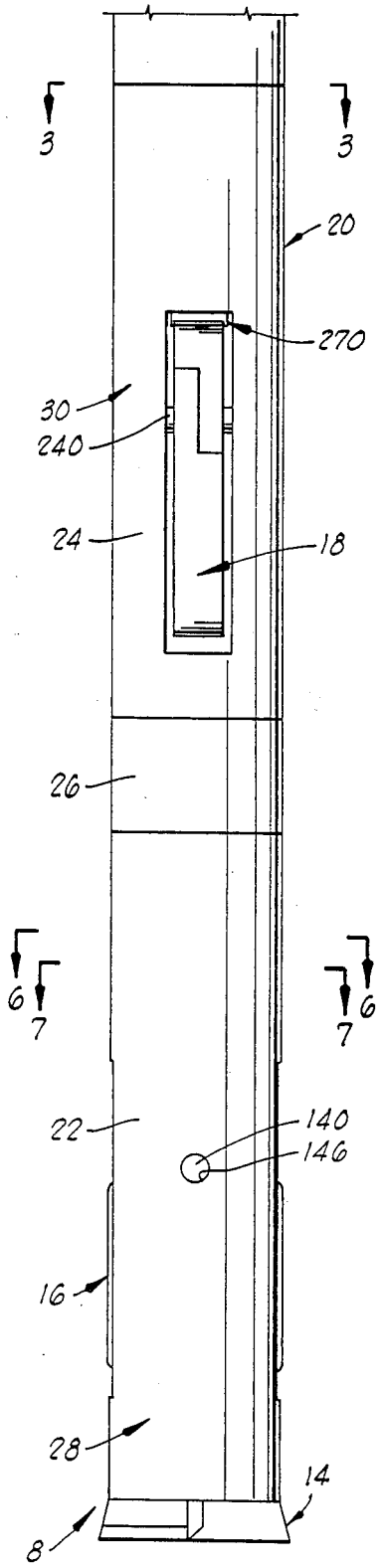
FIG. 2 is an elevational view of the tool schematically shown in FIGS. 1A–1C.

FIGS. 1A–1C illustrate three stages of usage of the present invention within a downhole environment. This environment includes a well bore 2 having a cased or uncased borehole. As illustrated, the well bore 2 is cased with suitable casing 4 (e.g., 7-inch casing).

Disposed within the well bore 2 is a tubing string 6 of a suitable type as known to the art (e.g., 4½-inch tubing). As illustrated, the tubing string 6 is centered coaxially within the casing 4; however, the present invention is also useful where a tubing string is off-centered.

Lowered into the tubing string 6 is a downhole enhanced diameter clean-out tool 8 schematically shown in FIGS. 1A–1C but more particularly described hereinbelow and embodying a preferred embodiment of the apparatus of the present invention. The tool 8 is moved into and out of the tubing string 6 and the well bore 2 on suitable conveyancing means 10 of a type as known to the art. One example of such a conveyancing means is a coil tubing motor apparatus of a type as known to the art for rotating and lowering (and subsequently raising) the tool 8. An example of a coil tubing motor apparatus is one including a SLIMDRIL motor of SlimDril, Inc. of Houston, Tex. Another example of a conveyancing means is a tubing string of smaller diameter than the tubing string 6.

The downhole tool 8 is used to cut material 12 located in the borehole and/or the tubing string 6. An example of such material is cement which has been pumped into the well bore for a known purpose and which has set up (hardened).

FIG. 1A illustrates the tool 8 at an initial stage of cutting. This cutting occurs within the tubing string 6 and is done with cutting elements 14 located on the bottom end (as oriented in FIG. 1A) of the tool 8. The cutting elements 14 have an overall width substantially equal to the width of the main body of the tool 8; therefore, the cutting elements 14 cut material within a path which is in line with the tool 8 and which has a cross-sectional area substantially the same as the maximum cross-sectional area of the main body of the tool 8. Cutting is also done in part by extendible members 16, 18 which are partially extended by fluid pressure exerted down through the conveyancing means 10 to the tool 8 in a manner known to the art. The members 16, 18 are only partially extended because they are limited by the inner diameter of the tubing string 6 which is not to be cut by the tool 8. Prior to application of fluid pressure, the members 16, 18 are fully retracted to the position illustrated in FIG. 4.

Figure 4:
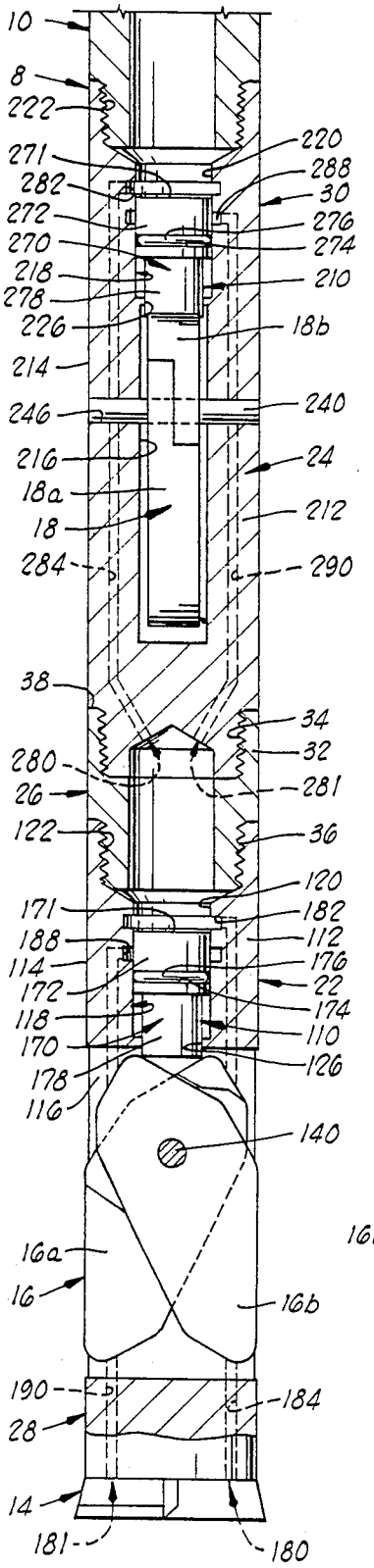
FIG. 4 is a sectional elevational view, taken along line 4—4 shown in FIG. 3, wherein the sets of extendible elements are in retracted positions.
Figure 5:
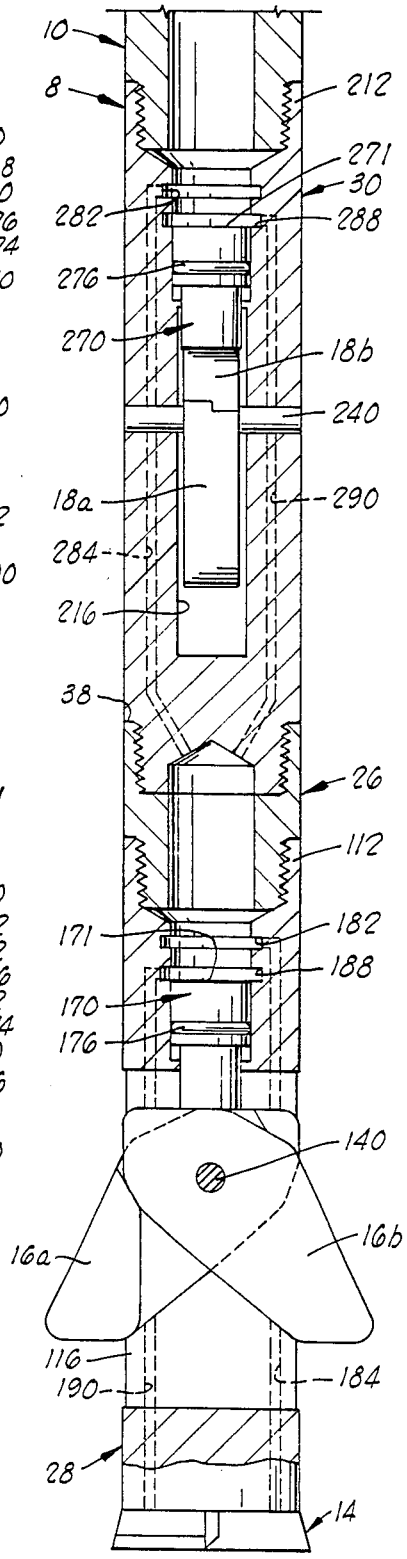
FIG. 5 is a sectional elevational view as illustrated in FIG. 4, but showing, the sets of extendible elements in extended positions.
Figure 3:
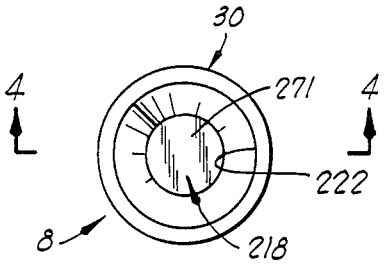
FIG. 3 is a top view of the tool as taken along line 3—3 shown in FIG. 2 but without the illustrated connected conveyancing structure.

As the conveyancing means 10 rotates and lowers the tool 8, cutting continues as just described until the lower set of extendible members 16 (comprising two pieces 16*a*, 16*b* in the depicted preferred embodiments and shaped as shown in FIGS. 4 and 5) is moved below the bottom of the tubing string 6. This position is illustrated in FIG. 1B. At this point of the operation, the fluid (e.g., hydraulic) pressure exerted through the tubing string 6 opens farther the cutting members 16, which thereafter cut a wider (i.e., enhanced diameter) path radially beyond what the bottom cutting elements 14 cut. As subsequently described, a signal is generated for communication to the surface at this time so that accurate positioning of the tool 8 can be known (i.e., by indicating that the lower members 16 are just below the tubing string 6, which has a length which is known). Such signal also indicates the opening or extension and the degree of opening or extension of the set of members 16.

Continued rotation and lowering of the tool 8 ultimately moves the upper set of members 18, functioning primarily as stabilizers but also being of a cutting construction (and shaped) the same as the members 16 so that the members 18 are sometimes referred to herein as an upper set of cutting members, below the bottom of the tubing string 6 and into open or extended positions in response to the fluid pressure within the tubing string 6. This position is illustrated in FIG. 1C. Another signal is generated at this time to mark the position of the tool 8 and the opening (and degree thereof) of the stabilizer members 18 (which are illustrated as including two pieces 18*a*, 18*b*). Use of the stabilizers in this exemplary environment, wherein the tool 8 is driven by a coil tubing motor, is important to enhance the stability of the tool 8 during rotation within the wider region below the tubing string 6, which enhanced stability reduces vibrations or "chattering" arising from the tool being rotated within a cut region having a significantly wider diameter than the diameter of the main support body of the tool 8.

With reference to FIGS. 2–9, preferred embodiments of the downhole cutting tool 8 will be more particularly described. The tool 8 includes an elongated support 20 comprising a cylindrical body 22, a cylindrical body 24, and connector means 26 for connecting the two bodies 22, 24 to establish an angle between the set of cutting members 16 associated with the body 22 and the set of cutting members 18 associated with the body 24. The cylindrical body 22 provides support for a lower subassembly 28, and the cylindrical body 24 provides support for an upper subassembly 30. In the preferred embodiment of FIG. 2 the two subassemblies are connected through an adapter defined by the connector means 26.

The connector means 26, or adapter, of the preferred embodiments of FIGS. 2–9 has a cylindrical shape defined by an annular wall 32 (FIGS. 4 and 5). A threaded inner surface 34 defines a coupling receptacle for threadedly engaging with a mating portion of the cylindrical body 24. A threaded outer surface 36 is part of a protuberant portion of the adapter 26 for engaging with a mating portion of the cylindrical body 22. The adapter 26 is used in the preferred embodiments to establish a predetermined angle by which a longitudinal plane in which the stabilizing cutting members 18 are retained is circumferentially offset from a longitudinal plane in which the cutting members 16 are retained. This offset is obtained by appropriately machining an upper radial surface 38 against which a surface of the body 24 abuts when the body 24 is connected to the adapter 26. That is, by machining the surface 38, one can control the degree to which the cylindrical body 24 can be screwed into the adapter 26 thereby defining the relationship between a longitudinal plane of the cutting members 18 and the body of the adapter 26 and thus the relationship to the lower cylindrical body 22. This angular offset is important to provide for the enhanced rotational stability. In the illustrated preferred embodiments the angle is about 90° (as illustrated, a longitudinal plane for the members 16 could include the sheet containing FIG. 4 and a longitudinal plane for the members 18 would include one perpendicular to the sheet containing FIG. 4). Of course, this relative positioning could be obtained by other suitable means. As is apparent from the drawings, the cylindrical body of the adapter 26 spaces or separates the two bodies 22, 24 from each other but connects them in line with each other.

In describing the remainder of the preferred embodiments of the tool 8 shown in FIGS. 2–9, reference will be made primarily only to the lower subassembly 28 because the upper subassembly 30 includes the same type of components. This is indicated by the numbering scheme used hereinbelow wherein the additional components of the lower assembly 28 described hereinbelow will be defined with numerals in the 100's with the corresponding components of the upper subassembly 30 being indicated parenthetically by corresponding numbers in the 200's.

The cylindrical support body 22 (24) has the two overlapping cutting members 16 (18) pivotally mounted therein. A movement means 110 (210) is disposed in the support body 22 (24) for moving the cutting members 16 (18) to their respective extended positions; this movement occurs in response to a force acting on the movement means 110 (210) to move it from a first position to a second position. As previously mentioned the cutting elements 14, effectively defining a mill of a suitable type, are attached to the bottom end of the support body 22 for creating a pilot hole through which the tool 8 moves as it is rotated through the material to be cleaned-out.

The support body 22 (24) of the preferred embodiment is an elongated, hollow cylindrical member having a side wall 112 (212) with an exterior surface 114 (214). Defined laterally or diametrically through the lower (as viewed in the drawings) portion of the body 22 (24) nearer its lower end is a longitudinal slot 116 (216) intersecting diametrically opposite portions of the exterior surface 114 (214). Extending above (as viewed in the drawings) and communicating with the slot 116 (216) is a longitudinal (specifically, an axial) cavity 118 (218). The cavity 118 (218) extends between an upper end of the support body 22 (24) and the slot 116 (216).

The cavity 118 (218) has a longitudinal section defined by an inner surface 120 (220) of the wall 112 (212). Above the surface 120 there is a portion of the cavity 118 which is threaded, as identified by the reference numeral 122, for connecting with the surface 34 of the adapter 26 (as for the body 24, the corresponding surface 222 is for connecting with the conveyancing means 10 by which the tool 8 is lowered into a well bore). The lower portion of the surface 120 (220) is a piston-receiving cavity section. Another cavity section, defined by an inner surface 126 (226), has a diameter smaller than the diameter of the surface 120 (220). The surface 126 (226) defines a portion of the cavity 118 (218) for receiving a portion of the movement means 110 (210) as will be more particularly described hereinbelow.

The cutting members 16 (18) are pivotally connected within the slot 116 (216) of the support body 22 (24) by means of a single pin 140 (240). The pin 140 (240) has an overall length which is not longer than the diameter of the portion of the body 22 (24) in which the pin 140 (240) is retained. The pin 140 (240) is retained in a diametrical hole 146 (246) defined through the side wall 112 (212) of the support body 22 (240).

The pin 140 (240) extends through a hole defined substantially centrally within each of the members of the pair 16 (18) as is apparent from the drawings. These holes are aligned so that the two cutting members themselves are overlapping, as is also apparent from the drawings. The members of the pair 16 (18) pivot simultaneously, but in opposite directions about the axis defined by the pin 140 (240) for moving between the fully retracted position illustrated in FIG. 4 and the fully extended position illustrated in FIG. 5.

The cutting members 16 (18) are constructed so that each has a similar shape and each defines a cutting blade (as for the members 18, these are also cutting blades in the illustrated preferred embodiment, but they can simply be members which provide the needed stability without necessarily being cutting blades). Each blade **16*a*, 16*b* (18*a*, 18*b*) has a lower edge defining a cutting surface having a predetermined length so that, when the members 16 (18) are held in the overlapping relationship and fully extended position illustrated in FIG. 5, the lower edges substantially align. In the preferred embodiment the overall length defined by the two overlapping, fully extended blades is not greater than the inner diameter of a casing in which the tool 8** is to be used.

The blades are extended by movement of the movement means 110 (210). In the preferred embodiment, the movement means 110 (210) includes a piston 170 (270) slidably mounted in the cavity 118 (218) [specifically, within the piston receiving section defined by the lower portion of the surface 120 (220)]. The piston 170 (270) includes a diametric surface 171 (271) against which pressurized liquid (or, more generally, fluid) is caused to act when the cutting members 16 (18) are to be moved to their extended positions. The piston 170 (270) has a sealing body portion 172 (272) with a longitudinal surface extending from the diametric surface 171 (271) toward the cutting members 16 (18) and about which is defined a circumferential groove 174 (274) in which a sealing member, such as an O-ring 176 (276), is retained for sealingly engaging the surface 120 (220). The piston 170 (270) has a sufficient diameter across the sealing body portion 172 (272) relative to the diameter across the surface 120 (220) of the cavity 118 (218) to establish a metal-to-metal seal between the longitudinal surface of the piston 170 (270) and the surface 120 (220). A neck portion 178 (278) extends from the portion 172 (272) of the piston 170 (270). The neck portion 178 (278) extends from the cavity portion defined by the surface 120 (220) and through the neck receiving portion defined by the surface 126 (226) into engagement with the respective cutting members 16 (18). As shown in FIGS. 4 and 5, this engagement occurs when the members 16 (18) are either in the fully retracted positions or the fully extended positions. Although this continual engagement is illustrated in FIGS. 4 and 5, the principal purpose of the piston 170 (270) is to move the overlapping cutting members 16 (18) to their respective extended positions so that when the members 16 (18) are in their fully retracted positions and are not at that time to be moved outwardly, the piston 170 (270) need not necessarily engage the cutting members 16 (18), so long as suitable engagement can subsequently be obtained when the cutting members are to be moved to their extended positions. Although there is not one in the illustrated preferred embodiments, the piston 170 (270) could have an axial channel defined longitudinally therethrough to allow fluid flow through the piston 170 (270) between the cavity 118 (218) and the slot 116 (216).

Referring again to the body 22 (24), it further includes two channel means 180, 181 (280, 281).

The channel means 180 (280) is defined in the body 22 (24) and circumferentially spaced from the slot 116 (216). The channel means 180 (280) allows communication of a liquid from the cavity 118 (218) to an outlet of the channel means 180 (280) regardless of the position of the piston 170 (270) between its uppermost and lowermost positions.

In the preferred embodiments, the channel means 180 (280) includes a circumferential groove 182 (282) defined in the body 22 (24) in communication with the cavity 118 (218). The groove 182 (282) is disposed adjacent the diametric surface 171 (271) of the piston 170 (270), but it is not covered by the longitudinal surface of the body portion 172 (272) of the piston 170 (270) when the piston is at its uppermost position. That is, for the orientation shown in FIG. 4, for example, the top of the piston 170 (270) is just below the groove 182 (282).

Figure 8:
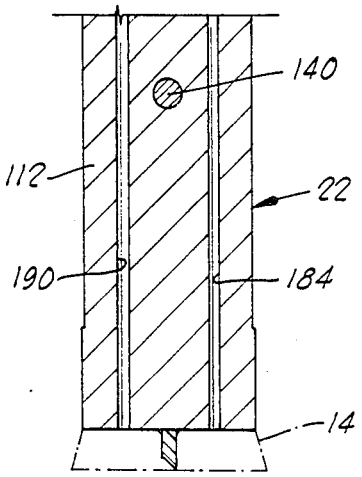
FIG. 8 is a sectional elevational view taken along line 8—8 shown in FIG. 7.
Figure 6:
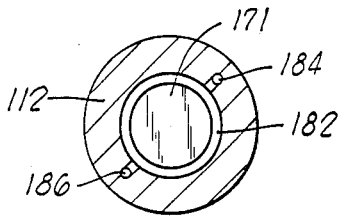
FIG. 6 is a sectional view taken along line 6—6 shown in FIG. 2.
Figure 7:
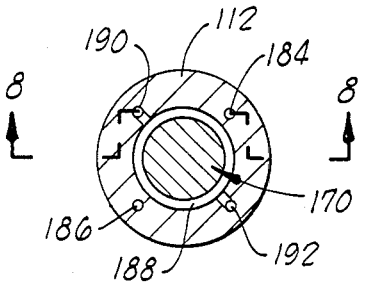
FIG. 7 is a sectional view taken along line 7—7 shown in FIG. 2.
Figure 9:
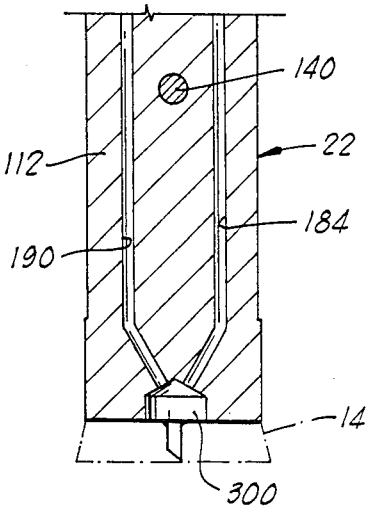
FIG. 9 is a sectional elevational view as shown in FIG. 8 but showing passageways converging to a central indentation in the bottom of the tool.

The channel means 180 (280) also includes a passageway defined in the body 22 (24) communicating with the circumferential groove 182 (282) and extending towards an end of the body 22 (24). As illustrated, the passageway is specifically a longitudinal bore 184 (284) having its upper end connected to the groove 182 (282) and having its lower end, defining the outlet, disposed near the lower end of the body 22 (24). This positioning of the outlet allows liquid to be communicated through the channel means to the cutting means 14. This aids the cutting process, the flushing process by which the cut material is removed from the well bore, and the equalization of pressure between the interior and exterior of the tool 8. In the embodiment illustrated in FIG. 8, this lower end of the bore 184 opens through the lower end of the body 22. In the embodiment illustrated in FIG. 9, this lower end of the longitudinal bore 184 communicates with a central indentation 300 defined by an axial bore extending upwardly from the bottom surface of the body 22. It is to be noted that the two configurations in FIGS. 8 and 9 illustrate only the body 22 of the lower subassembly 28. As to the upper subassembly 30, the bore 284 communicates in a configuration similar to FIG. 9 (see FIGS. 4 and 5) with the central passageway communicating through the adapter 26 into the interior of the body 22.

The channel means 180 (280) of the preferred embodiments further includes another passageway 186 (see FIGS. 6 and 7) (not shown for channel means 280) defined in the body 22 (24) diametrically opposite the longitudinal bore 184 (284). This other passageway communicates with the circumferential groove 182 (282) and extends towards the lower end of the body 22

(24). In the preferred embodiments the passageway 186 (not shown for channel means 280) is identical to the longitudinal bore 184 (284) except for its diametrically opposite positioning.

The channel means 181 (281) is defined in the body 22 (24) and spaced from the slot 116 (216) and the channel means 180 (280). The channel means 181 (281) communicates a liquid (or more generally, a fluid) from the cavity 118 (218) to an outlet of the channel means 181 (281) in response to the piston 170 (270) moving from its uppermost position to its lowermost position, which lowermost position is illustrated in FIG. 5.

The channel means 181 (281) includes a circumferential groove 188 (288) defined in the body 22 (24) in communication with the cavity 118 (218). The groove 188 (288) is disposed between the diametric surface 171 (271) of the piston 170 (270) and the cutting members 16 (18) so that it is covered by the longitudinal surface of the sealing body portion 172 (272) of the piston 170 (270) when the piston 170 (270) is at its uppermost position illustrated in FIG. 4 but so that the groove 188 (288) is uncovered from such longitudinal surface when the piston 170 (270) is at its lowermost position illustrated in FIG. 5. That is, the groove 188 (288) is just below (as viewed in the drawings) the groove 182 (282). In the preferred embodiments this positioning is such that the groove 188 (288) is between the groove 182 (282) and the sealing member 176 (276) of the piston 170 (270) regardless of the positioning of the piston 170 (270) between its uppermost and lowermost positions. Stated differently, the sealing member 176 (276) is disposed on its piston 170 (270) so that the sealing member does not pass the circumferential groove 188 (288) in response to movement of the piston 170 (270) between its lowermost and uppermost positions of movement. Because of the metal-to-metal seal established between the piston 170 (270) and the cavity surface 120 (220), there is no significant leakage into the groove 188 (288) when the piston 170 (270) overlies or blocks the groove 188 (288).

The channel means 181 (281) includes a passageway defined in the body 22 (24) in communication with the circumferential groove 188 (288) and extending towards an end of the body 22 (24). This passageway is defined in the preferred embodiment by a longitudinal bore 190 (290) having an end disposed within the body 22 (24) nearer the lowermost position of the piston 170 (270) and having another end, defining the outlet of the channel means 181 (281), disposed near an end of the body 22 (24). This other, or lower in the preferred embodiments, end of the longitudinal bore 190 (290) is disposed near the lower end of the body 22 (24) so that liquid is communicated to the cutting area through the channel means 181 (281) in response to the piston 170 (270) moving from its uppermost position to its lowermost position as illustrated by the change in positions shown in FIGS. 4 and 5. With respect to the lower subassembly 28, the lower end of the bore 190 opens directly through the lower end surface of the body 22 (FIG. 8) or through communication with the central indentation 300 (FIG. 9). With respect to the upper subassembly 30, the lower end of the channel 290 communicates with the lower axial passageway communicating through the adapter 26 into the lower subassembly 28 in a manner analogous to the configuration shown in FIG. 9 for the lower subassembly 28.

The channel means 181 (281) of the preferred embodiments further includes another passageway 192 (see FIG. 7) (not shown for the channel means 281), which is defined in the body 22 (24) diametrically opposite the bore 190 (290). The passageway 192 (not shown for the channel means 281) is constructed the same as the bore 190 (290) and communicates with the circumferential groove 188 (288) and extends towards the lower end of the body 22 (24).

With the foregoing construction of the channel means 180, 181 280, 281, the two support bodies 22, 24 are connected through the hollow adapter 26 so that the outlets of the channel means 280, 281 communicate fluid with the cavity 118 of the body 22 as is best illustrated in FIGS. 4 and 5. With this construction, liquid or other fluid present within the cavity 218 of the body 24 is continuously communicated through the passageway or bore 284 and the diametrically opposite one into the cavity 118 of the body 22 and through the passageways or bores 184, 186 of the body 22. Additional liquid or fluid is communicated through the passageway or bore 290 and the corresponding diametrically opposite one when the piston 270 is in its lower position, and additional liquid or fluid is communicated through the passageways or bores 190, 192 when the piston 170 is in its lower position. This communication through the passageways or bores 190, 192, 290 and the one diametrically opposite the bore 290 provides the means by which signals can be generated and sent to the surface for indicating when the respective pistons 170, 270 have moved to their respective lower position, which movement opens the respective pair of cutting members 16, 18. The magnitudes of these pressure signals indicate how far open the grooves 188, 288 and the cutting members 16, 18 are.

With reference again to FIGS. 1A–1C, the operation of the tool 8 will be more particularly described. The lower and upper subassemblies 28, 30 are connected through the connector means 26 so that the plane of the cutting members 16 is angularly offset by the predetermined amount (about 90° in the preferred embodiment) from the longitudinal plane of the cutting members 18. This assembly is connected to a carrier tubing string or other conveyancing means 10, such as a coil tubing motor apparatus, for carrying the tool 8 into the well bore. For the environment illustrated in FIGS. 1A–1C, this carrying occurs by lowering the tool 8 on the conveyancing means 10 through the tubing string 6. This lowering occurs until the lower end of the tool 8, which contains the cutting or milling elements 14, reaches the top of the material which is to be cut. At this location, the tool 8 is rotated so that the cutting elements 14 mill or bore through the material 12 located in the tubing string 6. During this boring operation, the cutting members 16, 18 remain retracted within the tool 8 unless the fluid pressure is applied to extend partially the members 16, 18 as is the case illustrated in FIG. 1A.

The clean-out tool 8 of the preferred embodiments is rotated and lowered against the material 12 in the tubing string 6 so that the lower cutting elements 14 and partially extended members 16, 18 cut a path through the material 12 in the tubing string 6 and on into the wider diameter region below the tubing string 6 within the casing 4. During this operation a pressurized fluid is applied to the tool 8 down through the conveyancing means 10 and into the cavity 218 of the upper subassembly 30. This pressurized fluid acts against the diametric surface 271 of the piston 270 in the upper subassembly 30, and this pressurized fluid also passes through the circumferential groove 282 and the bore 284 and the corresponding diametrically opposite one which extend from the groove 282. The fluid passing through these bores enters the cavity 118 of the lower subassembly 28 whereupon it acts upon the diametric surface 171 of the piston 170 and also passes through the bores 184, 186. This application of pressurized fluid moves the cutting members 16 to respective extended cutting positions when this pair of cutting members is lowered below the lower end of the tubing string 6 and into the borehole, which is cased with the casing 4 for the environment illustrated in FIGS. 1A–1C. This position of the tool 8 is illustrated in FIG. 1B. This opening occurs through the action of the piston 170 pushing downwardly on the pair of cutting members 16 to obtain the relationship illustrated in FIG. 5.

With the cutting members 16 in their extended positions, the tool 8 is continued to be rotated and lowered against the material 12 so that both the cutting elements 14 and the cutting members 16 cut through the material 12 within the casing 4. During this continued rotation and lowering and the opening of the cutting members 16, there is transmitted to the surface from which the borehole of the well bore 2 and the tubing string 6 extend a signal indicating the cutting members 16 have moved to extended positions within the borehole below the tubing string 6. This signal is generated by the opening of the groove 188 and the bores 190, 192 and the consequent flow of fluid therethrough, whereby a pressure drop in the pressurized fluid, which drop can be detected at the surface, occurs due to the increased flow volume then permitted by the opened bores 190, 192. Less than full extension of the blades **16*a*, 16*b* would be indicated by a smaller pressure drop if the piston 170 remained blocking part of the groove 188**.

The method of cutting using the preferred embodiment of the present invention further includes maintaining applying a pressurized fluid to the tool 8 so that the cutting members 18 are moved to their cutting positions when these members are lowered below the tubing string 6 and into the borehole. During this time the method further includes maintaining rotating and lowering the tool 8 against the material 12 in the borehole through and after the aforementioned step of transmitting a signal to the surface.

The method further includes transmitting to the surface another signal, this one indicating that the members 18 have moved to extended, stabilizing positions within the borehole below the tubing string 6. This transmission occurs in response to the piston 270 moving below the groove 288 so that the liquid or fluid within the cavity 218 then also passes through the bore 290 and the corresponding diametrically opposite bore, whereby another pressure drop in the pressurized fluid occurs due to this increased flow volume. Again, partial extension would be indicated by a smaller pressure drop when the piston 270 remains blocking part of the groove 288.

With both sets of cutting members 16, 18 open, the method includes maintaining the two pairs of cutting members in their respective extended positions simultaneously, and concurrently continuing rotating and lowering the tool 8 against the material 12 in the borehole. Having the members 16 open cuts the material 12 from the casing 4 (without damaging the casing 4), and having the members 18 open stabilizes the rotating tool 8. It is contemplated that additional sections corresponding to the subassembly 30 can be attached to obtain other sets of stabilizing members.

When the cutting operation has been completed, pressure is removed from the tool 8, and thus from the pistons 170, 270 so that as the tool 8 is extracted from the well bore, the tubing string 6, or any other encountered obstacle of sufficient opposing force, engages the extended portions of the cutting members 16, 18 and forces them downwardly into their retracted positions illustrated in FIG. 4.

Figure 10:
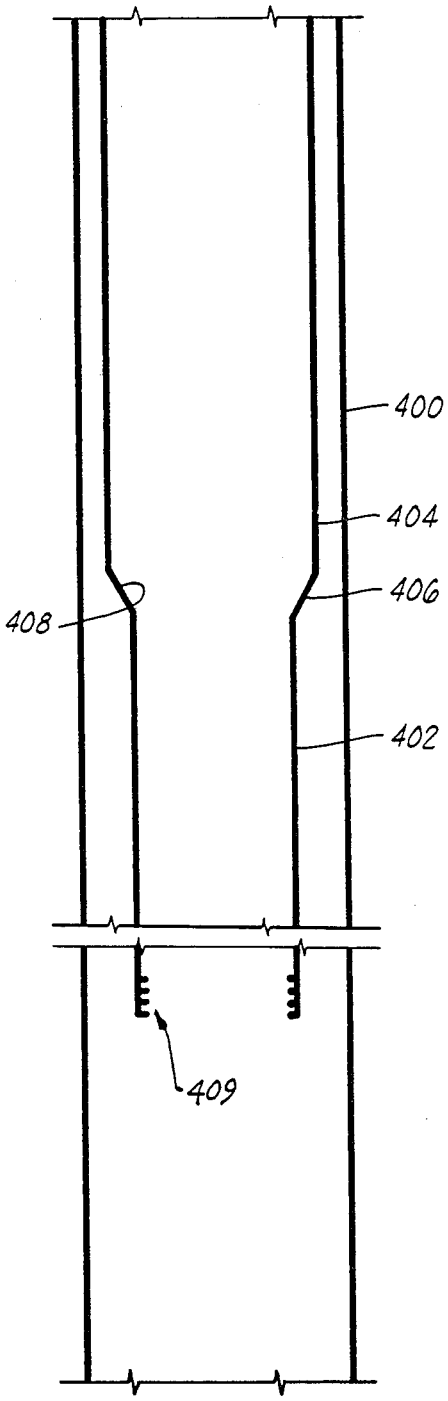
FIG. 10 is a schematic illustration of casing in which are disposed two tubing strings of different diameters (but both smaller than the diameter of the casing) connected in line; this illustrates another structure in which the present invention is contemplated to have utility.

Another application of the present invention includes cleaning out downhole tubulars within regions having more than two different cross-sectional areas. In FIG. 10 there is schematically illustrated a combination of tubulars including a casing 400 having the largest diameter illustrated in FIG. 10, a lower tubing string 402 having the smallest diameter of the tubulars illustrated in FIG. 10, and an upper tubing string 404 having an intermediate diameter. The tubing strings 402, 404 are interfaced and connected linearly through a suitable adapter joint 406 having a frusto-conical (inwardly tapering in going from upper to lower end as viewed in FIG. 10, thereby defining a constriction in the tubing) surface 408. A profile nipple 409 is shown connected to the lower end of the tubing string 402.

Figure 11A:
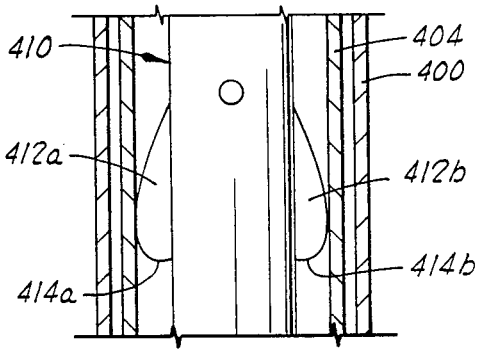
FIG. 11A schematically shows a portion of another embodiment of the clean-out tool of the present invention under pressure and positioned in the larger diameter tubing string of the structure represented in FIG. 10.
Figure 11B:
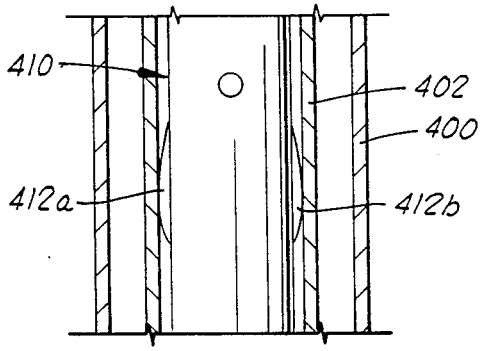
FIG. 11B schematically shows the portion of the tool depicted in FIG. 11A after it has been lowered into the smaller diameter tubing string of the structure represented in FIG. 10.
Figure 11C:
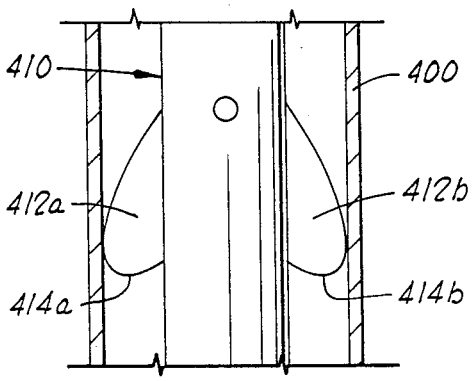
FIG. 11C schematically shows the same portion of the tool depicted in FIGS. 11A and 11B but now lowered below the connected tubing strings and into the casing of the structure represented in FIG. 10.

If the material to be cut or cleaned-out extends up into the tubing string 404, the cutting tool of the present invention is operated: initially within the string 404 wherein the extendible cutting members are concurrently opened by fluid pressure to an intermediate position substantially equal to the inner diameter of the upper portion of the tubing string 404; then secondly within the string 402 wherein the extendible cutting members are concurrently opened by fluid pressure to an extent less than where they were positioned within the string 404 but substantially equal to the inner diameter of the lower portion tubing string 402; and then thirdly within the casing string 400 wherein the extendible cutting members are opened by fluid pressure to their farthest of the three exemplary locations of usage (i.e., substantially the inner diameter of the casing 400). At each of these locations the tool is rotated when the members are opened to achieve cutting. Three such locations are illustrated in FIGS. 11A, 11B and 11C, respectively. These drawings show only a lower portion of a tool 410 of the present invention wherein a pair of extendible cutting blades **412*a*, 412*b* are pivotally mounted. The tool 410 is identical to any of the previously described preferred embodiments of the tool 8 except that the blades 412*a*, 412*b* (otherwise corresponding to the cutting members 16) have a different shape from that shown in FIGS. 4 and 5 for the members 16*a*, 16*b*. One or more upper sets of extendible members which correspond to the members 18 have, in the embodiment depicted in FIGS. 11A–11C, the same shape as the blades 412*a*, 412*b***.

The blades **412*a*, 412*b* have rounded corner ends 414*a*, 414*b* is respectively, as best seen in FIG. 11C. The curvature of these ends is sufficient to cause the blades 412*a*, 412*b* to ride down the sloped surface 408 and to be pushed thereagainst, by the weight of the conveyancing string on which the tool 410 is carried, into a more retracted position so that the blades 412*a*, 412*b* are pushed into the body of the tool 410 sufficiently to enable the tool 410 to fit into the smaller diameter tubing string 402. The curvature of the outer corners 414*a*, 414*b* is also sufficient to enable the blades 412*a*, 412*b* to ride through the even smaller diameter of the profile nipple 409 without damaging the nipple 409**. This curvature for the preferred embodiment depicted in FIGS.

11A–11C causes the lower edges of the blades 412*a*, 412*b*- to extend obliquely above horizontal when the blades 412*a*, 412*b* are fully extended as illustrated in FIG. 11C.

To accommodate the change in outer periphery of the blades so that adequate full retraction and extension can still be achieved, changes to the blade inner surfaces engaging the respective pistons and to the abutment surfaces of one blade against which the other blade abuts in full retracted or extended position are made consistent with a specific curvature used on the corner ends 414*a*, 414*b* (and the remainder of the outer periphery if it, too, is curved, such as is illustrated in FIGS. 11A–11C).

It is further contemplated that the present invention can be used in other combinations of one, two or more sizes of inner diameters within a borehole, whether going from larger to smaller diameter or vice-versa as between any two consecutive portions.

From the foregoing it is apparent that the preferred embodiments of the present invention provide a structure which has an enhanced stability within the borehole when both pairs of extendible members are in their extended positions. Such preferred embodiments also provide two signals confirming that the cutting members have opened and accurately indicating where the tool is; however, it is contemplated that this feature can be used without the stabilizing feature and vice versa. These signals are generated through a construction which also directs the liquid or fluid flow to the lower cutting region to assist in flushing the cuttings from the well bore. Thus, the present invention is well adapted to carry out the objects and attain the ends and advantages mentioned above as well as those inherent therein. While preferred embodiments of the present invention have been described for the purpose of this disclosure, changes in the construction and arrangement of parts and the performance of steps can be made by those skilled in the art, which changes are encompassed within the spirit of this invention as defined by the appended claims.

What is claimed is:

1. A downhole cutting tool, comprising:

a body including a slot defined laterally therethrough and further including a longitudinal cavity defined therein in communication with said slot;

two cutting members pivotally mounted in said slot;

movement means, disposed in said cavity so that said movement means is movable between a first position in said cavity and a second position in said cavity, for moving said cutting members to respective extended positions in response to a force acting on said movement means to move said movement means from said first position to said second position; and said body further including:

first channel means, defined in said body and spaced from said slot, for communicating a liquid from said cavity to an outlet of said first channel means regardless of the position of said movement means between said first and second positions; and second channel means, defined in said body and spaced from said slot and said first channel means, for communicating a liquid from said cavity to an outlet of said second channel means in response to said movement means moving from said first position to said second position.

2. A tool as defined in claim 1, wherein:

said first channel means includes a longitudinal bore having an end disposed within said body near said first position of said movement means and having another end, defining said outlet of said first channel means, disposed near an end of said body; and said second channel means includes a longitudinal bore having an end disposed within said body nearer said second position of said movement means than said end of said first channel means and having another end, defining said outlet of said second channel means, disposed near an end of said body.

3. A tool as defined in claim 2, wherein:

said body includes a first end through which said cavity is defined and a second end near which said slot is defined;

said another end of said longitudinal bore of said first channel means opens through said second end of said body; and said another end of said longitudinal bore of said second channel means opens through said second end of said body.

4. A tool as defined in claim 2, wherein:

said body includes a first end through which said cavity is defined and a second end near which said slot is defined, said second end having a central indentation defined therein;

said another end of said longitudinal bore of said first channel means communicates with said central indentation; and said another end of said longitudinal bore of said second channel means communicates with said central indentation.

5. A tool as defined in claim 2, wherein:

said body includes a first end through which said cavity is defined and a second end near which said slot is defined;

said tool further comprises cutting means, disposed at said second end of said body, for cutting material within a path having a cross-sectional area substantially the same as the maximum lateral cross-sectional area of said body;

said another end of said longitudinal bore of said first channel means is disposed near said second end of said body so that liquid is communicated through said first channel means to said cutting means; and said another end of said longitudinal bore of said second channel means is disposed near said second end of said body so that liquid is communicated through said second channel means to said cutting means in response to said movement means moving from said first position to said second position.

6. A tool as defined in claim 1, wherein:

said movement means includes a piston disposed in said cavity in engagement with said cutting members, said piston including:

a diametric surface against which pressurized liquid is caused to act when said cutting members are to be moved to their respective extended positions; and a longitudinal surface extending from said diametric surface towards said cutting members;

said first channel means includes:

a first circumferential groove defined in said body in communication with said cavity, said first circumferential groove disposed adjacent said diametric surface of said piston but not covered by said longitudinal surface of said piston when said piston is at said first position of said movement means; and a first passageway defined in said body, said first passageway communicating with said first circumferential groove and extending towards an end of said body; and said second channel means includes: a second circumferential groove defined in said body in communication with said cavity, said second circumferential groove disposed between said diametric surface of said piston and said cutting members so that said second circumferential groove is covered by said longitudinal surface of said piston when said piston is at said first position of said movement means, but so that said second circumferential groove is at least partially uncovered from said longitudinal surface of said piston when said piston is at said second position of said movement means; and a second passageway defined in said body, said second passageway communicating with said second circumferential groove and extending towards an end of said body.

7. A tool as defined in claim 6, wherein said piston has a sealing member disposed thereon at a position along said longitudinal surface so that said sealing member does not pass said second circumferential groove in response to movement of said piston between said first and second positions of said movement means.

8. A tool as defined in claim 6, wherein:

said first channel means further includes a third passageway defined in said body diametrically opposite said first passageway, said third passageway communicating with said first circumferential groove and extending towards an end of said body; and said second channel means further includes a fourth passageway defined in said body diametrically opposite said second passageway, said fourth passageway communicating with said second circumferential groove and extending towards an end of said body.

9. A tool as defined in claim 1, further comprising:

a second body, including a slot defined laterally therethrough and further including a longitudinal cavity defined therein in communication with said slot of said second body;

two cutting members pivotally mounted in said slot of said second body;

second movement means, disposed in said cavity of said second body so that said second movement means is movable between a first position in said cavity of said second body and a second position in said cavity of said second body, for moving said two cutting members pivotally mounted in said slot of said second body to respective extended positions in response to a force acting on said second movement means to move said second movement means from said first position to said second position of said second movement means;

said second body further including:

third channel means, defined in said second body and spaced from said slot in said second body, for communicating a liquid from said cavity of said second body to an outlet of said third channel means regardless of the position of said second movement means between said first and second positions thereof; and fourth channel means, defined in said second body and spaced from said slot of said second body and said third channel means, for communicating a liquid from said cavity of said second body to an outlet of said fourth channel means in response to said second movement means moving from said first position to said second position thereof; and said second body connected to said first-mentioned body so that said outlets of said third and fourth channel means communicate with said cavity of said first-mentioned body.

10. A tool as defined in claim 9, wherein said second body is connected to said first-mentioned body so that said cutting members mounted in said slot of said second body are offset from said cutting members mounted in said slot of said first-mentioned body at an angle for enhancing rotational stability.

11. A tool as defined in claim 10, wherein said angle is about 90°.

12. A tool as defined in claim 1, wherein:

said body defines part of an elongated support;

said two cutting members define a first pair of extendible members pivotally connected to said support to move between retracted and extended positions within a first longitudinal plane;

said movement means defines first movement means, disposed in said support, for moving said first pair of extendible members to respective extended positions; and said tool further comprises:

a second pair of extendible members pivotally connected to said support to move between retracted and extended positions within a second longitudinal plane, said second plane offset at an angle form said first plane so that said first and second pairs of extendible members effect enhanced rotational stabilization; and second movement means, disposed in said support, for moving said second pair of extendible members to respective extended positions.

13. A tool as defined in claim 12, wherein said angle is about 90°.

14. A tool as defined in claim 12, wherein said support includes:

said body characterized as a first cylindrical body, including said slot characterized as a first longitudinal slot defined laterally therethrough and further including said longitudinal cavity characterized as a first longitudinal cavity defined therein between an end of said first cylindrical body and said first longitudinal slot, said first longitudinal slot having said first pair of extendible members mounted therein and said first longitudinal cavity having said first movement means disposed therein;

a second cylindrical body, including a second longitudinal slot defined laterally therethrough and further including a second longitudinal cavity defined therein between an end of said second cylindrical body and said second longitudinal slot, said second longitudinal slot having said second pair of extendible members mounted therein and said second longitudinal cavity having said second movement means disposed therein; and connector means for connecting said second cylindrical body and said first cylindrical body to establish said angle between said first and second planes.

15. A tool as defined in claim 14, wherein said connector means includes a third cylindrical body, including a first end threadedly connected to said end of said first cylindrical body and further including a second end threadedly connected to another end of said second cylindrical body so that said second cylindrical body is spaced from, but in line with, said first cylindrical body.

16. A downhole cutting tool, comprising:

an elongated support having a continuous fluid communication path defined therein;

a first pair of extendible members pivotally connected to said support to move between retracted and extended positions within a first longitudinal plane;

first movement means, disposed in said support, for moving said first pair of extendible members to respective extended positions, said first movement means including a first piston disposed within said fluid communication path above said first pair of extendible members;

a second pair of extendible members pivotally connected to said support above said first pair of extendible members to move between retracted and extended positions within a second longitudinal plane;

second movement means, disposed in said support, for moving said second pair of extendible members to respective extended positions at a time subsequent to said first movement means moving said first pair of extendible members to their respective extended positions, said second movement means including a second piston disposed within said fluid communication path above said second pair of extendible members, said first and second pistons movable within said fluid communication path independently of each other; and wherein said second plane is offset at an angle from said first plane so that said first and second pairs of extendible members effect enhanced rotational stabilization in response to said first and second movement means moving said first and second pairs of extendible members to their respective extended positions and maintaining them thereat.

17. A tool as defined in claim 16, wherein said angle is about 90°.

18. A tool as defined in claim 16, wherein said support includes:

a first cylindrical body, including a first longitudinal slot defined laterally therethrough and further including a first longitudinal cavity defined therein between an end of said first body and said first slot, said first slot having said first pair of extendible members mounted therein and said first cavity having said first movement means disposed therein;

a second cylindrical body, including a second longitudinal slot defined laterally therethrough and further including a second longitudinal cavity defined therein between an end of said second body and said second slot, said second slot having said second pair of extendible members mounted therein and said second cavity having said second movement means disposed therein; and connector means for connecting said second body and said first body to establish said angle between said first and second planes.

19. A tool as defined in claim 18, wherein said connector means includes a third cylindrical body, including a first end threadedly connected to said end of said first body and further including a second end threadedly connected to another end of said second body so that said second body is spaced from, but in line with, said first body.

20. A method of cutting material located within a borehole having a tubing disposed therein, said method comprising the steps of:

lowering a clean-out tool into the tubing, which clean-out tool includes: a first pair of members movable below the tubing to an extended position in response to a pressurized fluid, and a second pair of members movable below the tubing to an extended position in response to a pressurized fluid;

rotating and lowering the clean-out tool through the lower end of the tubing and into the borehole;

applying a pressurized fluid to the clean-out tool so that the first pair of members is moved to its extended position when the first pair of members is lowered below the tubing and into the borehole;

transmitting, to the surface from which the borehole and tubing extend, a signal indicating the first pair of members has moved to its extended position within the borehole below the tubing;

maintaining rotating and lowering the clean-out tool in the borehole through and after said step of transmitting and cutting the material with the extended first pair of members;

maintaining applying a pressurized fluid to the clean-out tool so that the second pair of members is moved to its extended position when the second pair of members is lowered below the tubing and into the borehole;

transmitting to the surface a signal indicating the second pair of members has moved to its extended position within the borehole below the tubing; and maintaining the first and second pairs of members in their respective extended positions simultaneously, and concurrently continuing rotating and lowering the clean-out tool against the material in the borehole, and stabilizing the rotating clean-out tool with the extended second pair of members and cutting the material in the borehole with the extended first pair of members.

21. A method as defined in claim 20, wherein:

the first-mentioned step of transmitting includes opening a first longitudinal channel, defined through a lower portion of the clean-out tool, to the pressurized fluid; and the second-mentioned step of transmitting includes opening a second longitudinal channel, defined through an upper portion of the clean-out tool, to the pressurized fluid.

22. A method as defined in claim 21, wherein the step of lowering a clean-out tool into the tubing includes:

rotating the clean-out tool within an upper portion of the tubing having a first diameter;

applying a pressurized fluid to the clean-out tool so that the first and second pairs of members are extended substantially to the first diameter within the upper portion of the tubing;

lowering the clean-out tool through a constriction in the tubing so that the first and second pairs of members engage the constriction and are moved back to a second diameter smaller than the first diameter;

rotating the clean-out tool within a lower portion of the tubing below the constriction, which lower portion has a diameter substantially equal to the second diameter; and applying a pressurized fluid to the clean-out tool so that the first and second pairs of members are extended substantially to the diameter of the lower portion of the tubing within the lower portion of the tubing.

23. A downhole cutting tool, comprising:

an elongated support;

a first pair of extendible members pivotally connected to said support to move between retracted and extended positions within a first longitudinal plane;

first movement means, disposed in said support, for moving said first pair of extendible members to respective extended positions;

a second pair of extendible members pivotally connected to said support to move between retracted and extended positions within a second longitudinal plane, said second plane offset at an angle from said first plane so that said first and second pairs of extendible members effect enhanced rotational stabilization;

second movement means, disposed in said support, for moving said second pair of extendible members to respective extended positions; and wherein said support includes:

a first cylindrical body, including a first longitudinal slot defined laterally therethrough and further including a first longitudinal cavity defined therein between an end of said first body and said first slot, said first slot having said first pair of extendible members mounted therein and said first cavity having said first movement means disposed therein;

a second cylindrical body, including a second longitudinal slot defined laterally therethrough and further including a second longitudinal cavity defined therein between an end of said second body and said second slot, said second slot having said second pair of extendible members mounted therein and said second cavity having said second movement means disposed therein; and connector means for connecting said second body and said first body to establish said angle between said first and second planes.

24. A tool as defined in claim 23, wherein said connector means includes a third cylindrical body, including a first end threadedly connected to said end of said first body and further including a second end threadedly connected to another end of said second body so that said second body is spaced from, but in line with, said first body.

* * * * *